United States Patent [19]

Waschulewski

[11] 4,440,034

[45] Apr. 3, 1984

[54] ECCENTRIC VIBRATOR WITH SHIFTING COUPLING

[75] Inventor: Hans-Georg Waschulewski, Mettmann, Fed. Rep. of Germany

[73] Assignee: Losenhausen Maschinenbau AG, Fed. Rep. of Germany

[21] Appl. No.: 239,698

[22] Filed: Mar. 2, 1981

[30] Foreign Application Priority Data

Apr. 5, 1980 [EP] European Pat. Off. ..... 80101838.3

[51] Int. Cl.[3] ..... B06B 1/16

[52] U.S. Cl. ..... 74/61

[58] Field of Search ..... 74/61, 87; 404/113–117

[56] References Cited

U.S. PATENT DOCUMENTS

| | | | |
|---|---|---|---|
| 3,505,885 | 4/1970 | Waschulewski et al. | 74/61 |
| 3,618,485 | 11/1971 | Hermann | 404/117 |
| 3,722,302 | 3/1973 | Piatkowski et al. | 74/61 |
| 4,193,309 | 3/1980 | Nagano | 74/501 R |

FOREIGN PATENT DOCUMENTS

| | | | |
|---|---|---|---|
| 220651 | 4/1962 | Austria | 74/61 |
| 1015275 | 9/1957 | Fed. Rep. of Germany . | |
| 2008055 | 10/1973 | Fed. Rep. of Germany . | |
| 1484588 | 9/1976 | Fed. Rep. of Germany . | |
| 349932 | 12/1960 | Switzerland . | |

*Primary Examiner*—Lawrence J. Staab

*Attorney, Agent, or Firm*—Laney, Dougherty, Hessin & Beavers

[57] ABSTRACT

An eccentric vibrating machine which includes parallel shafts each carrying an eccentric mass. A gear rotatably journalled on a first of the shafts is drivingly connected to the second shaft for mutual rotation of the gear and second shaft. A shifting coupling is mounted on the first shaft and is selectively engageable with the gear at multiple angular positions around the gear to couple the first shaft to the gear and thereby selectively vary the phase angle relationship of the eccentric masses carried on the two shafts. A manual shifting control device is carried on the first shaft, and can be manually actuated to selectively engage the shifting coupling with the gear.

7 Claims, 3 Drawing Figures

ECCENTRIC VIBRATOR WITH SHIFTING COUPLING

BACKGROUND OF THE INVENTION

1. Field of the Invention

This invention relates to a vibrating machine of the type in which vibratory motion and periodic directional force resultants are developed by the use of eccentric masses concurrently rotated about parallel axes in opposite directions. The direction of the acting force resultants is selectively varied by means of a shifting coupling which is used to change the angular phase relationship of the eccentric masses to each other.

2. Brief Description of the Prior Art

An eccentric mass vibratory machine utilizing concurrently rotating, parallel shafts, each carrying eccentric weights or masses, is disclosed in German Pat. No. 1,015,275. One shaft has a thick gear secured to the shaft for rotation therewith. The second shaft has a pair of discs fixed thereto and spaced longitudinally therealong. The discs carry dogs. A second gear carrying dog-engaging stops on its opposite side faces is rotatably and slidably mounted on the second shaft between the two discs, and meshes with the gear on the first shaft. The stops on the second gear are angularly offset from each other therearound so that, by shifting the second gear axially on the second shaft into engagement with one or the other of the discs, the angular phase relationship of the eccentric masses carried on the shafts is selectively varied.

This arrangement has several disadvantages. The relative angular displacement of the shafts and their eccentrics, and thus the direction of vibrations generated, is effected in steps by repeated reciprocations of the axially shiftable gear on the second shaft. Therefore, the position of the shifting member used to effect a sliding reciprocation of the second gear does not provide an unambiguous and positive indication of the attained angular relationship of the two shafts and their respective eccentric masses.

Furthermore, in the described system it is, as indicated, necessary to axially reciprocate the torque transmitting second gear on the second shaft. In order to accommodate this axial motion of the second gear, the first gear affixed to the first shaft, which is in mesh with the reciprocating gear, must have a width adequate to allow such axial reciprocation. Moreover, the system requires the two described discs with their associated dogs to be located on opposite sides of the axially reciprocated gear. For these reasons, the shifting coupling becomes expensive, and the axial dimensions of the shifting coupling become undesirably large.

An actual, publicly used soil compactor which has been constructed using the general principles of the vibration generating machine described in German Pat. No. 1,015,275 provides for the optional attainment of only two angular positions as between the gear-carrying shafts and their eccentrics. These two angular positions are attained when the axially movable gear is coupled to either one or to the other disc. Therefore, each of the two angular positions corresponds to either a "Forward" or a "Reverse" direction of vibratory movement, and the disadvantage of speculative or ambiguous coupling actions leading to uncertainty in the angular relationship attained, characteristic of the mechanism described in the German patent, is obviated. Whether the system is coupled for "Forward" vibration or "Reverse" vibration will always be known. Nevertheless, this machine, while avoiding the disadvantage of ambiguous coupling and the resulting uncertain angular relationship, continues to possess the remaining disadvantages of the system described in German Pat. No. 1,025,275.

Another type of vibrating machine utilizing counter-rotating shafts and eccentric masses with a shifting coupling is disclosed in German Pat. No. 1,484,588. In this machine, two stops are provided within a housing which is attached to a gear rotatably mounted upon one of the two shafts. The shifting coupling forming a part of the assembly comprises a shifting ring mounted on the same shaft as this gear and housing, and susceptible to axial displacement along the shaft. The ring carries a dog which cooperates with a selected one of the two stops carried on the housing. These stops are angularly spaced around the housing by 180°. When the dog on the shifting ring is engaged with one of the stops, the gear which is carried on the housing is coupled to the shaft. Ramps or inclined surfaces are provided on the shifting ring, and these ramps in turn cooperate with cams carried on the shifting ring.

The shifting ring is actuated by moving it axially along the shaft upon which it is mounted, whereby the dog will be disengaged from one stop. At this time, the driven structure, i.e., the shaft which rotatably carried the gear and its associated housing, along with the eccentric carried on this shaft, will lag in its rotational velocity the drive shaft carrying a fixed gear. As the shifting ring continues its axial movement, the ramps on the end face of the gear are reached and the shifting ring is slightly axially shifted in the reverse direction prior to the time the next stop on the housing overtakes and engages the dog on the ring. This stop is offset angularly by 180° from the stop previously disengaged from the shifting ring.

The vibration machine described in German Pat. No. 1,484,588 also suffers from several disadvantages. The shifting ring is reciprocated axially to and fro with each coupling and uncoupling operation. Such reciprocation increases the wear on the ring and on the shaft upon which it is mounted. Moreover, the design is complex. Further, from outside the housing in which the system is located it is difficult to recognize the particular operative position of the shifting ring, and to immediately verify the status of its engagement with the housing stops. Finally, in the disclosed system the coupling force is transmitted laterally on the coupled gear, and thus imposes undesirable stresses.

German Auslegeschrift or Offenlegungschrift No. 2,008,055 discloses a vibrating machine which utilizes counter-rotating shafts carrying eccentric masses, and having a shifting coupling for changing the phase relationships of the shafts and their masses. Axially spaced stops are provided in a housing which is laterally affixed to a gear which is rotatably mounted on one of the shafts. A radially projecting dog extends from a shifting rod which is guided in the shaft carrying the housing and its associated gear, with such dog extending through a window provided in this shaft. In effecting coupling and decoupling of the shaft to the housing and associated gear, the shifting rod is moved to locate the dog in the plane and path of movement of either one or the other of the stops carried on the housing. With this arrangement, the impact which occurs following disengagement of the coupling, and at the time when the radial dog hits the next stop, acts directly on the shifting mechanism and severely stresses the shifting rod and its associated radial dog.

An object of the present invention is to design a shifting coupling which can be used to couple counter-rotating, eccentric mass-carrying shafts in a selected angular phase relationship, with such coupling designed so that the meshing gears utilized may have equal widths, and the need for axial displacement of one gear relative to another while continuing to mesh therewith can be avoided.

It is also an object to provide a shifting coupling of the type described such that the precise operative position of the coupling, and therefore the status of the counter-rotating shafts and their eccentric masses relative to each other, can easily be seen from outside the system by reference to a coupling actuator member.

Another object of the invention is to prevent the impact forces, developed at the time when an entrainment device forming a portion of the coupling hits a stop means, also forming a portion of the coupling, from being transmitted to the coupling shifting mechanism.

According to the invention, these and additional objects and advantages are achieved by including in the vibrating machine an entrainment device which comprises a lever pivotally mounted on the driven shaft of the system for pivotation about an axis which extends transversely to the axis of rotation of the driven shaft. With such an arrangement, the pivotable lever on the driven shaft is supported against the transmitted torque through the pivot bearings on a relatively long lever arm. These pivot bearings take up the impact forces developed upon engagement of the entrainment device to couple the shafts. The shifting mechanism acts in the plane of pivotal movement of the layer, and is not affected by the impact forces. The gears employed on the two shafts can be axially stationary on their respective shafts, and can have equal widths. Further, it is possible to immediately recognize the particular operative position or status of the coupling and entrainment device from the position of an external portion of the actuator member. The stop utilized for coupling and uncoupling can be provided directly on the driven gear and close to the central plane thereof. The entire arrangement can be made simple and compact.

Additional objects and advantages of the present invention will become apparent as the following detailed description of two preferred embodiments of the invention is read in conjunction with the accompanying drawings which illustrate such embodiments.

GENERAL DESCRIPTION OF THE DRAWINGS

DETAILED DESCRIPTION OF PREFERRED EMBODIMENTS OF THE INVENTION

Figure 1:
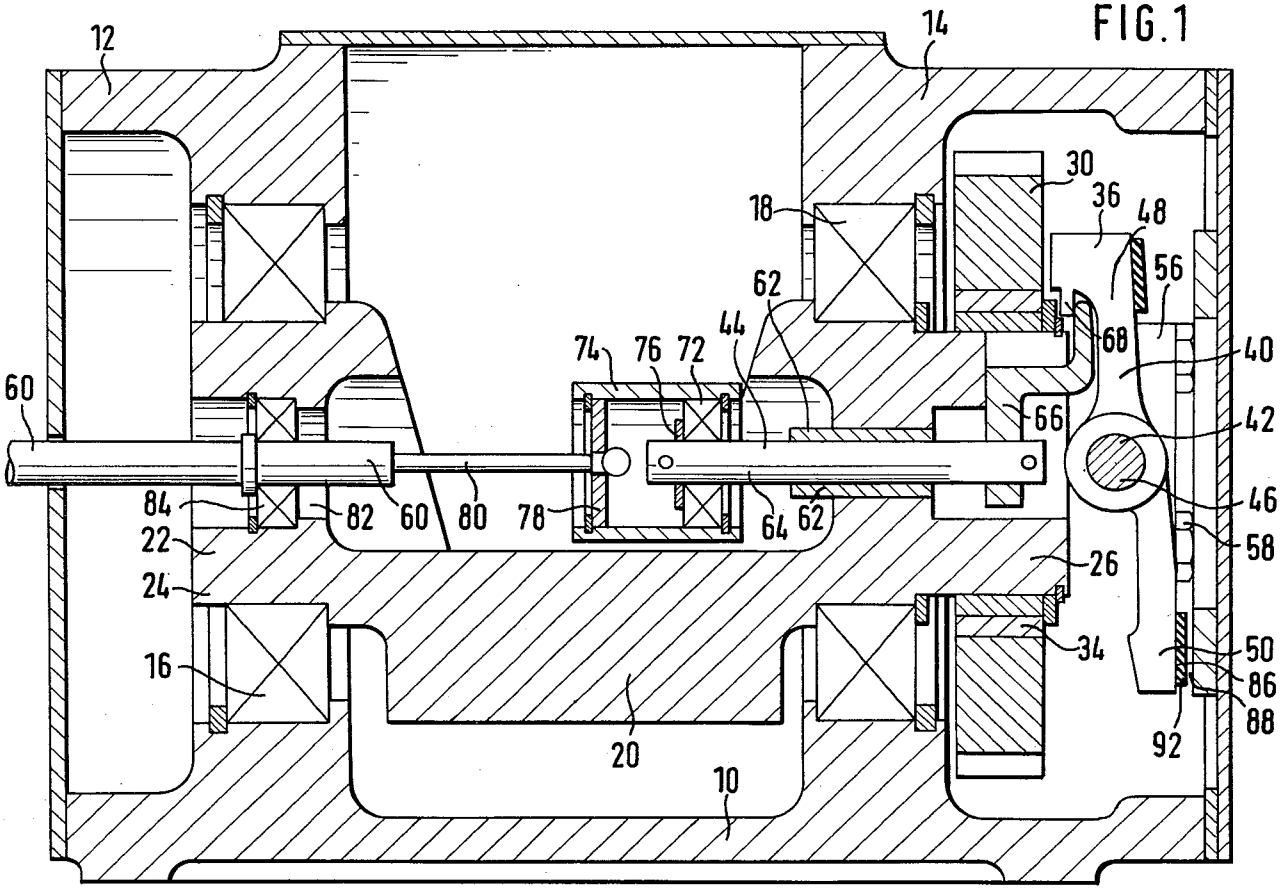
FIG. 1 is a sectional view of a vibrating machine constructed in accordance with the present invention, and taken along a plane containing the axis of rotation of one of the two parallel shafts used in the machine.
Figure 2:
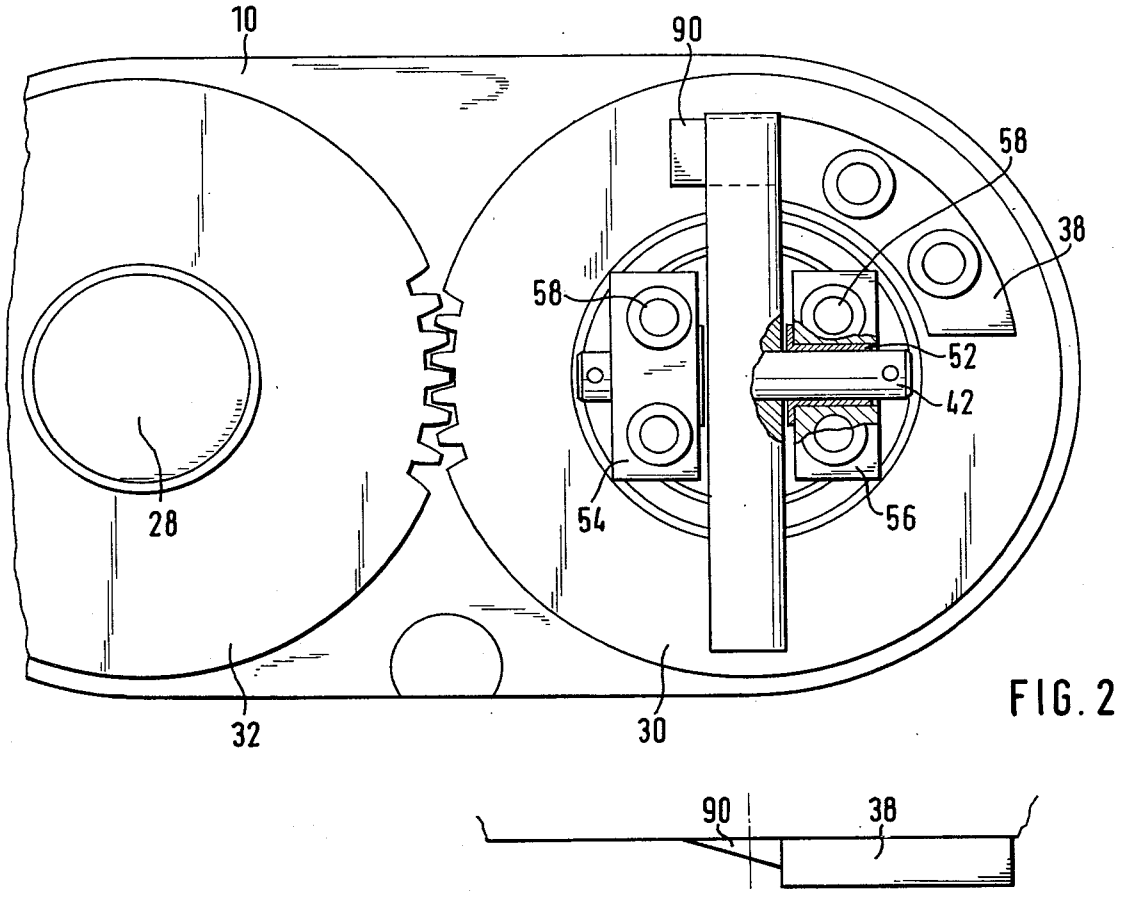
FIG. 2 is an axial view, partially in section, of the vibrating machine as it appears in end elevation with the cover removed.

In the embodiment of the invention illustrated in FIGS. 1 and 2, a housing for the vibrating machine is designated by reference numeral 10. An eccentric mass or weight 20 is mounted on, or formed integrally with, an unbalanced shaft 22. The shaft 22 is mounted in bearing brackets 12 and 14 through anti-friction bearings 16 and 18 by two stub axles 24 and 26. A similar eccentric mass or weight (not shown) is mounted on a second unbalanced shaft 28 which extends parallel to the shaft 22 and is rotatably supported in the housing 10. Gears 30 and 32 are mounted around the shafts 22 and 28, respectively, and mesh with each other. The gear 30 is rotatably mounted on the stub axle 26 of the unbalanced shaft 22 through a journal 34. The gear 32 is fixed to the unbalanced shaft 28 for rotation therewith. A shifting coupling, designated generally by reference numeral 36, is provided for coupling the gear 30 to the unbalanced shaft 22 in a manner hereinafter described.

The shifting coupling 36 comprises a stop 38 which is secured to the outer end face of the gear 30 as shown in FIG. 2. The coupling 36 further includes a two-armed lever 40 pivotally mounted on a shaft 42 for pivotation about an axis 46 which extends transversely and normal to the axis of rotation 44 of the unbalanced shaft 22. The two-armed lever 40 is movable between two operative coupling positions. In one operative coupling position, it engages the stop 38 with the arm 48. In the second and alternate coupling position, the lever 40 engages the stop 38 with the arm 50.

As will be perceived by reference to FIG. 2, the shaft 42 is mounted in bearing bushings 52 which are supported by bearing blocks 54 and 56 affixed to the end face of the stub axle 26 by screws 58.

Depending upon the positional status of the two-armed lever 40, the unbalanced shaft 22 is coupled with the gear 30 in a first position or in an alternate position which is angularly spaced from such first position by 180° around the gear. Thus, since the gear 30 meshes with the gear 32 fixed on the unbalanced shaft 28, the relative angular positions of the shafts 22 and 28, and therefore the relative angular positions of the oppositely rotating eccentric masses or weights carried on these shafts, is varied by changing the positional status of the lever 40. The resultant direction of vibration developed by the machine is changed in this manner. When the eccentric vibrating machine is used on a vibrator plate for soil compacting, one of the angular positions in which the unbalanced shaft 22 can be coupled to the gear 30 corresponds to a forward motion of the machine, while the other angular position results in a reverse motion.

In the case of the embodiment illustrated in FIG. 1, the mass distribution of the two-armed lever 40 about the axis of pivotation of the lever is asymmetric. For this reason, the centrifugal force acting on the arms of the lever when the shaft 22 undergoes rotation exerts a torque on the two-armed lever tending to pivot this lever about the pivotal axis 46 in a clockwise direction as the lever is viewed in FIG. 1. The centrifugal force-developed torque thus tends to pivot the arm 48 to the right, and the arm 50 to the left into a first coupling position.

A shifting device for actuating the shifting coupling 36 comprises a Bowden cable 60, which is used in conjunction with other structural elements included in the shifting device to apply traction to the lever 40 which is counteractive of the torque developed by the centrifugal force to which the lever is subjected as the shaft 22 undergoes rotation. Stated differently, the Bowden cable 60 and its associated elements in the shifting device can be used to develop a torque which acts in opposition to the torque caused by the centrifugal force of the shaft 22 and lever 40 in rotation. The Bowden cable 60 further includes an extensible core 80 connected to an axially movable rod 64 which is guided in the stub axle 26 by a bearing bushing 62. A Z-shaped lug 66 is provided on the end of the rod 64 opposite its end connected to the Bowden cable core 80 and extends behind a projection 68 provided on arm 48 of two-armed lever 40 and is also arranged to engage the inner surface of the arm 48 of the two-armed lever 40. The inner surface of the arm 48 to which the lug 66 is engaged faces the gear 30 as shown in FIG. 1.

The shifting device further includes a housing 74 which receives, through one of its ends, the inner end of the rod 64. The inner end of the rod 64 extends through an axially loadable ball spring 72 mounted inside the housing. A traction to the left can be exerted upon the rod 64, as it is viewed in FIG. 1, by the housing 74 through a disc 76 which is attached to the rod 74 and engages the inner race of the ball bearing 72. The housing 74 has an end wall 78 opposite the ball bearing 72, and the core 80 of the Bowden cable 60 is connected to this end wall. The Bowden cable 60 passes through an axial bore 82 in the stub shaft 24, and is extended through a ball bearing 84 which is mounted in such axial bore. The Bowden cable 60 thus does not undergo rotation with the shaft 22, and is guided laterally out of the housing 10.

Each of the arms 48 and 50 of the two-armed lever has a rear surface 86 which is exposed on the opposite side of each of the arms from the side which faces the gear 30. Each of the rear surfaces 86 has a brake lining 92 secured thereon. An annular stationary braking surface 88 is secured to the inner side of the housing 10 at a location which is concentric with respect to the axis of the shaft 22, and positioned in alignment with the rear surfaces 86 of the arms 48 and 50. A wedge-shaped cam 90 is provided on the end face of the gear 30 adjacent the stop 38, and is arranged to pivot one or the other of the respective arms 48 or 50 of the lever 50 away from the gear 30 shortly prior to the time that the respective arm engages the stop 38. In the course of a change in the coupling status so as to alter the angular relationship of the two shafts and their respective eccentric masses, one of the arms will initially engage the braking surface 88, and this engagement will continue until the other of the two arms contacts the cam 90 so as to be pivoted in a direction to disengage and terminate this braking contact.

The operation of the described arrangement is as follows:

When no traction is exerted on the Bowden cable 60, the rod 64 and its associated Z-shaped lug 66 move to the right as shown in FIG. 1 due to the action of the clockwise torque created by the centrifugal force acting on the two-armed lever 40. This torque causes the two-armed lever 40 to pivot clockwise. The arm 48 of the two-armed lever 40 is thus disengaged from the stop 38 and the arm 50 of the lever is swung into the path of the stop as it rotates with the gear 30. Clockwise pivotation of the arm 48 continues until the brake lining 92 carried on the back side of the arm 49 engages the braking surface 88.

This action effectively brakes the unbalanced shaft 22 and its associated eccentric mass 20 so that they lag the gear 30 which is driven in rotation by the gear 32. This lagging results in the stop 38 catching up to and engaging the arm 50. Immediately prior to the engagement of the arm 50 with the stop 38, however, the arm 50 is slightly rotated in a counterclockwise direction by virtue of its contact with the cam 90. Pivotation at this time causes the brake lining 92 on the arm 49 to be disengaged from the braking surface 88.

This first operative coupling position in which the arm 50 engages the stop 38 preferably corresponds to the traveling direction "Forward" of a soil compactor upon which the eccentric vibration machine is utilized. The reason for this is that to arrange the eccentric masses so that the forward direction of vibratory motion is attained at this time will assure that upon any failure of the Bowden cable, and more particularly, the core 80, the vibration machine will be set in its "Forward" operative position rather than in "Reverse."

To shift the eccentric vibrating machine into its second or "Reverse" operating mode, the Bowden cable 60 is operated to retract the core 80 and thereby move the housing 74 to the left as it is viewed in FIG. 1. This movement of the housing 74 moves the rod 64 to the left and, through the Z-shaped lug 66, pivots the two-armed lever 40 in a counterclockwise direction. The arm 50 is thus disengaged from the stop 38 and the arm 48 is moved into the path of the stop. Concurrently, the brake lining 92 carried on one side of the arm 50 is brought to bear against the braking surface 88, and remains in braking contact until such time as the arm 48 is pivoted slightly in a clockwise direction by contact with the cam 90.

Figure 3:
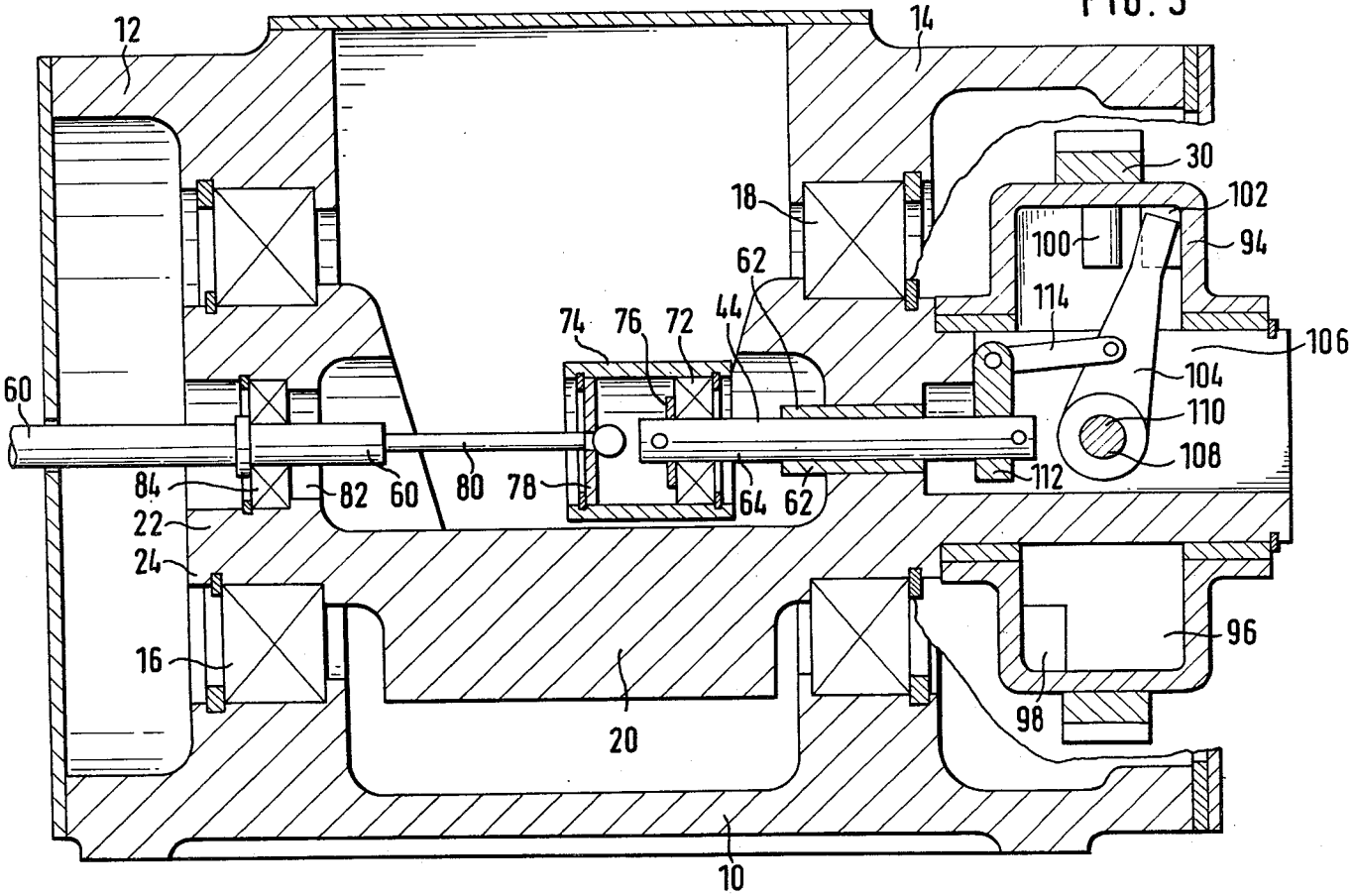
FIG. 3 is an illustration similar to FIG. 1, but showing a modified embodiment of the vibration machine of the invention.

A modified embodiment of the invention is illustrated in FIG. 3 of the drawings. In this embodiment, the housing, shafts, eccentric masses carried on the shafts, and the Bowden cable are the same as are illustrated in FIGS. 1 and 2, and the general arrangement and basic set-up of the eccentric vibrating machine is similar to that of the embodiment shown in FIG. 1. Corresponding structures in the two embodiments are designated by the same reference numerals. In the FIG. 3 embodiment, the gear 30 is a ring gear which is mounted upon the peripheral surface of an annular housing 94. The housing 94 is hollow and open toward the inside, and the gear is affixed to the housing so as to be mounted in substantially the central plane 96 thereof. The housing 94 is mounted for rotation on the shaft 22 by a suitable bearing structure.

A plurality of stops, preferably more than two, and designated by reference numerals 98, 100 and 102, are secured to the inner surface of the housing 94 on the hollow interior thereof. The stops 98, 100 and 102 are axially offset from each other in a direction parallel to the axis of the shaft 22, and are also circumferentially offset from each other around the annular housing so as to be angularly spaced from each other.

In the FIG. 3 embodiment, the lever employed is a single-arm lever 104 which is pivotally mounted on the shaft 22 by means of a shaft 110 disposed in a recess 106 formed in the shaft 22. The lever 104 pivots about an axis 108 located in the central plane of the housing 94 and extending transversely and normal to the axis 44 of the shaft 22. The lever 104 is connected to a radial lug 112 fixed to one end of the rod 64 by a link 114.

Upon axial movement of the rod 64 through use of the Bowden cable 60, the lever 104 is pivoted about its pivotal axis 108 and in this way can be brought consecutively into the paths of rotation of stops 102, 100 and 98. Engagement of the lever 104 with these respective stops is employed to couple the gear 30 to the shaft 22 at different angular positions. Preferably, the shifting device, including the Bowden cable 60, is provided with a plurality of detents and a corresponding number of detent positions which in turn correspond to the number of stops which are provided on the inner surface of the housing 94—three in number in the embodiment under consideration. The lever 104 is thus made to engage a respective one of the stops in each of the detent positions.

The embodiment illustrated in FIG. 3 and herein described permits a plurality of angular relative positions to be selectively set between the gear 30 and the unbalanced shaft 22. Such positions may, for example, correspond to the operating modes "Forward," "Stationary Vibration" and "Reverse." In contrast to the eccentric vibrating machine disclosed in German Pat. No. 1,015,275, the respective operating positions can be recognized unambiguously from the positions of the shifting mechanism, particularly when the preferred detents are provided. As compared to German Auslegeschift No. 2,008,055, a much more compact structure is provided by the present invention. Moreover, the lever 104 engages the stops closer to the central plane 96 of the housing 94 and gear 30, thereby enabling smaller tilting torques to become effective where torque is transmitted.

Although certain preferred embodiments of the invention have been herein described in order to effectively exemplify and illustrate the basic principles of the invention, it will be understood that various changes and modifications of structural elements and their relationships to each other can be effected without departure from such basic principles. Changes and innovations of this type are therefore deemed to be circumscribed by the appended claims or reasonable equivalents thereof.

What is claimed is:

1. An eccentric vibrating machine comprising:

an unbalanced, rotatable first shaft carrying a first eccentric mass offset from the first shaft axis of rotation;

an unbalanced rotatable second shaft carrying a second eccentric mass offset from the axis of rotation;

a first gear fixed to the first shaft for rotation therewith;

a second gear meshing with the first gear and rotatably positioned on the second shaft, said second gear including an end face; and coupling means for selectively coupling the second gear to the second shaft for rotation therewith and in a selected rotational phase relationship to said first shaft as both shafts are rotated and drivingly connected through said gears and coupling means, said coupling means comprising:

stop means associated with said second gear;

an entrainment device connected to the second shaft for rotation therewith and shiftable between at least two positions to selectively engage said stop means to variably establish driving connection between the second gear and second shaft at at least two different angular positional relationships therebetween, said entrainment device comprising:

a torque-transmitting lever pivotally mounted on the second shaft for pivotation about an axis extending transversely to the axis of rotation of said second shaft and for selective engagement by said lever with said stop means, whereby said lever transmits torque from said second gear to said second shaft; and shifting means for shifting the entrainment device between said positions for selective engagement of said lever with said stop means.

2. An eccentric vibrating machine as defined in claim 1 and further characterized in that:

(a) said stop means comprises a stop located on said end face of said second gear; and (b) the torque-transmitting lever of said entrainment device is a two-armed lever having a first torque-transmitting arm positioned for engagement with said stop in one of said positions, and having a second torque-transmitting arm positioned for engagement with said stop in another of said positions.

3. An eccentric vibrating machine as defined in claim 2 and further characterized in having:

stationary braking surface means adjacent said lever; and a cam on said end face of said second gear adjacent said stop;

and wherein each of said arms contacts said cam immediately prior to engagement with said stop, and is pivoted away from said gear end face by said cam, and each of said arms of said lever, when disengaged from said stop and from said cam, breakingly engages said braking surface means until the time when the other arm contacts said cam, at which time the arm not in contact with said cam is pivoted away from, and out of engagement with, said braking surface means.

4. An eccentric vibrating machine as defined in claim 3 and further characterized in having a brake lining on each of said arms of said lever on a side of the respective arm remote from the side thereof which contacts said cam.

5. An eccentric vibrating machine as defined in any one of claims 2–4 wherein:

(a) the mass distribution of said two-armed lever is asymmetric about the pivotal axis of the lever such that the centrifugal force acting on the lever as the lever rotates with said second shaft exerts a torque on the lever about its pivotal axis pivoting the lever to one of said positions; and (b) said shifting means comprises a Bowden cable assembly connected to the lever for exerting a traction thereon counteractive of the torque caused by the centrifugal force developed upon rotation of said second shaft.

6. An eccentric vibrating machine as defined in claim 1 and further characterized as including:

a hollow, annular housing rotatably mounted on said second shaft and carrying said second gear as a ring around the outer periphery thereof at a location in substantial alignment with the central plane of said annular housing;

and wherein said stop means comprises a plurality of spaced stops on the hollow interior side of said annular housing, said stops being offset from each other in a direction parallel to the axis of said second shaft, and being circumferentially spaced from each other around said annular housing; and wherein said lever is an arm pivotally connected to said second shaft for rotation with said second shaft and for pivotation about an axis located substantially in said central plane and extending normal to the longitudinal axis of said second shaft.

7. An eccentric vibrating machine as defined in claim 6 and further characterized in that:

more than two stops are provided on the hollow interior side of said annular housing;

said shifting means comprises a plurality of detents and has a plurality of detent positions corresponding in number to the number of said stops; and said lever is connected to said shifting means and movable in correspondence to movement of said shifting means between said detent positions to selectively engage a respective one of said stops in each of said detent positions.

* * * * *